US007196473B2

(12) United States Patent
Tökés et al.

(10) Patent No.: US 7,196,473 B2
(45) Date of Patent: Mar. 27, 2007

(54) DIELECTRIC BARRIER DISCHARGE LAMP

(75) Inventors: József Tökés, Budapest (HU); István Maros, Budapest (HU); Lajos Reich, Budapest (HU); László Bánkuti, Budapest (HU)

(73) Assignee: General Electric Company, Schenectady, NY (US)

( * ) Notice: Subject to any disclaimer, the term of this patent is extended or adjusted under 35 U.S.C. 154(b) by 363 days.

(21) Appl. No.: 10/843,854

(22) Filed: May 12, 2004

(65) Prior Publication Data

US 2005/0253522 A1 Nov. 17, 2005

(51) Int. Cl.
*H01J 11/02* (2006.01)

(52) U.S. Cl. ..... 313/607; 313/573; 313/634

(58) Field of Classification Search ..... 313/634, 313/607–616, 485, 493, 573
See application file for complete search history.

(56) References Cited

U.S. PATENT DOCUMENTS 4,837,484 A * 6/1989 Eliasson et al. ..... 313/634
4,983,881 A * 1/1991 Eliasson et al. ..... 313/607
5,173,638 A * 12/1992 Eliasson et al. ..... 313/634
5,604,410 A 2/1997 Vollkommer et al.
5,666,026 A * 9/1997 Matsuno et al. ..... 313/634
5,763,999 A 6/1998 Matsuno et al.
5,994,849 A 11/1999 Vollkommer et al.
6,034,470 A 3/2000 Vollkommer et al.
6,060,828 A 5/2000 Vollkommer et al.
6,246,171 B1 6/2001 Vollkommer et al.
6,304,028 B1 10/2001 Vollkommer et al.
2001/0022499 A1 * 9/2001 Inayoshi ..... 313/607
2002/0067130 A1 6/2002 Falkenstein
2002/0163311 A1 * 11/2002 Hitzschke et al. ..... 315/56

* cited by examiner

*Primary Examiner*—Ashok Patel
*Assistant Examiner*—Christopher Raabe
(74) *Attorney, Agent, or Firm*—Fay Sharpe LLP

(57) ABSTRACT

A dielectric barrier discharge (DBD) lamp is disclosed. The DBD lamp comprises a discharge vessel, which encloses a discharge volume filled with discharge gas. The discharge vessel further comprises a phosphor layer within the discharge volume. The discharge vessel comprises an outer tubular portion having an internal surface, and an inner tubular portion having an outward surface. The outer tubular portion surrounds the inner tubular portion. In this manner, a substantially annular discharge volume is enclosed between the outer tubular portion and the inner tubular portion. The inner tubular portion comprises a multitude of protrusions around its circumference. The protrusions extend into the substantially annular discharge volume. A first set of interconnected electrodes and a second set of interconnected electrodes are also provided. The electrodes are isolated from the discharge volume by at least one dielectric layer, and at least one of the dielectric layers is constituted by the wall of the inner tubular portion.

24 Claims, 5 Drawing Sheets

DIELECTRIC BARRIER DISCHARGE LAMP

BACKGROUND OF THE INVENTION

This invention relates to a dielectric barrier discharge lamp.

Of the various low pressure discharge lamps known in the art, the majority are the so-called compact fluorescent lamps. These lamps have a gas fill which also contains small amounts of mercury. Since mercury is a highly poisonous substance, novel types of lamps are being recently developed. One promising candidate to replace mercury-filled fluorescent lamps is the so-called dielectric barrier discharge lamp (shortly DBD lamp). Besides eliminating the mercury, it also offers the advantages of long lifetime and negligible warm-up time and independence of ambient temperature. Concerning these latter two features, a DBD lamp is comparable to an incandescent lamp.

As explained in detail, for example, in U.S. Pat. No. 6,060,828, the operating principle of DBD lamps is based on a gas discharge in a noble gas (typically Xenon). The discharge is maintained through a pair of electrodes, of which at least one is covered with a dielectric layer. An AC voltage of a few IV with a frequency in the kHz range is applied to the electrode pair. Often, multiple electrodes with a first polarity are associated to a single electrode having the opposite polarity. During the discharge, exciters (excited molecules) are generated in the gas, and electromagnetic radiation is emitted when the meat-stable exciters dissolve. The electromagnetic radiation of the exciters is converted into visible light by suitable phosphors, in a physical process similar to that occurring in mercury-filled fluorescent lamps. This type of discharge is also referred to as di electrically impeded discharge.

As mentioned above, DBD lamps must have at least one electrode set which is separated from the discharge gas by a dielectric. It is known to employ the wall of the discharge vessel itself as the dielectric. Various discharge vessel-electrode configurations have been proposed to satisfy this requirement. U.S. Pat. No. 5,994,849 discloses a planar configuration, where the wall of the discharge vessel acts as a dielectric. The electrodes with opposite polarities are positioned alternating to each other. The arrangement has the advantage that the discharge volume is not covered by electrodes from at least one side, but a large proportion of the energy used to establish the electric field between the electrodes is dissipated outside the discharge vessel. On the other hand, a planar lamp configuration can not be used in the majority of existing lamp sockets and lamp housings, which were designed for traditional incandescent bulbs.

In order to increase the efficiency, it has been proposed to put the electrodes within the discharge vessel, to lower the dissipation losses occurring outside the discharge vessel. U.S. Pat. Nos. 6,034,470 and 6,304,028 disclose two different DBD lamp configurations, where both set of electrodes are located within the discharge vessel, which confines the discharge gas atmosphere. The electrodes are covered with a thin layer of dielectric. However, none of these lamp configurations are suitable for a low-cost mass production, because the thin dielectric layers need an additional process step, and they are prone to premature aging, which quickly destroys their insulating properties.

U.S. Pat. No. 5,763,999 and U.S. Patent application Publication No. US 2002/0067130 A1 disclose DBD light source configurations with an elongated and annular discharge vessel. The annular discharge vessel is essentially a double-walled cylindrical vessel, where the discharge volume is confined between two concentric cylinders having different diameters. A first set of electrodes is surrounded by the annular discharge vessel, so that the first set of electrodes is within the smaller cylinder, while a second set of electrodes is located on the external surface of the discharge vessel, i.e. on the outside of the larger cylinder.

This known arrangement has the advantage that none of the electrode sets need any particular insulation from the discharge volume, because the walls of the discharge vessel provide stable and reliable insulation. However, the external electrodes are visually unattractive, block a portion of the light, and also need to be insulated from external contact, due to the high voltage fed to them.

U.S. Pat. No. 6,246,171 B1 also discloses discharge vessel-electrode configurations where both the first and second sets of electrodes are located on the same side of a discharge vessel wall, similar to that proposed in U.S. Pat. No. 5,994,849. However, this configuration has the inherent disadvantage that the intensity of the electric field within the discharge volume is relatively small, and this negatively affects the efficiency of the lamp. On the contrary, the stray electric field (i.e. the field which is outside of the discharge volume, and hence useless for the purposes of the discharge) is relatively large. Therefore, U.S. Pat. No. 6,246,171 B1 also proposes to place the electrodes on two opposing surfaces of the discharge vessel, enclosing the discharge volume between the opposing surfaces, similarly to the solutions described above, albeit not for an annular discharge vessel but for a flat radiator. In this manner, a larger portion of the electric field will penetrate the discharge volume, and will contribute more effectively to the discharge. However, this arrangement again has the disadvantage that the electrodes will be visible from that side onto which they were applied.

Therefore, there is a need for a DBD lamp configuration with an improved discharge vessel-electrode configuration, which does not interfere with the aesthetic appearance of the lamp. There is also need for an improved discharge vessel-electrode configuration which ensures that the electric field within the discharge volume is homogenous and strong, and thereby effectively contributes to the barrier discharge. It is sought to provide a DBD lamp, which, beside having an improved electrode-discharge vessel arrangement, is relatively simple to manufacture, and which does not require expensive thin-film dielectric layer insulations of the electrodes and the associated complicated manufacturing facilities. Further, it is sought to provide a discharge vessel which readily supports electrode sets which are easy to apply directly onto the discharge vessel walls, but which will still have a reduced stray electric field.

SUMMARY OF THE INVENTION

In an embodiment of the present invention, there is provided a dielectric barrier discharge (DBD) lamp. The DBD lamp comprises a discharge vessel, which encloses a discharge volume filled with discharge gas. The discharge vessel further comprises a phosphor layer within the discharge volume. The discharge vessel comprises an outer tubular portion having an internal surface, and an inner tubular portion having an outward surface. The outer tubular portion surrounds the inner tubular portion. In this manner, a substantially annular discharge volume is enclosed between the internal surface of the outer tubular portion and the outward surface of the inner tubular portion. The inner tubular portion comprises a multitude of protrusions around its circumference. The protrusions extend into the substantially annular discharge volume. There is also provided a first set of interconnected electrodes and a second set of interconnected electrodes. The electrodes are isolated from the discharge volume by at least one dielectric layer, and at least one of the dielectric layers is constituted by the wall of the inner tubular portion.

According to another aspect of the invention, there is provided a discharge vessel for a DBD lamp. The discharge vessel encloses a sealed discharge volume, which may be filled with discharge gas. The discharge vessel comprises an outer tubular portion having an internal surface and an inner tubular portion having an outward surface. The outer tubular portion surrounds the inner tubular portion, so that a substantially annular discharge volume is enclosed between the internal surface of the outer tubular portion and the outward surface of the inner tubular portion. The inner tubular portion comprises a multitude of protrusions around its circumference. The protrusions extend into the substantially annular discharge volume.

The disclosed DBD lamp ensures that the electrodes also protrude into the discharge volume, so that the lines of force of the electric field will extend into the discharge volume, and the lamp will have a good efficiency. The electrodes may be located external to the discharge vessel, and yet do not cover the external surface of the lamp. Further, no sealed lead-through or any dielectric covering layer film for the electrodes is required. More importantly, the electrodes remain within the inner tube, being essentially unnoticeable, so the overall aesthetic appearance of the lamp is undisturbed. The lamp can provide a uniform and large illuminating surface.

BRIEF DESCRIPTION OF DRAWINGS

The invention will be now described with reference to the enclosed drawings, where.

DETAILED DESCRIPTION OF THE INVENTION

Figure 1:
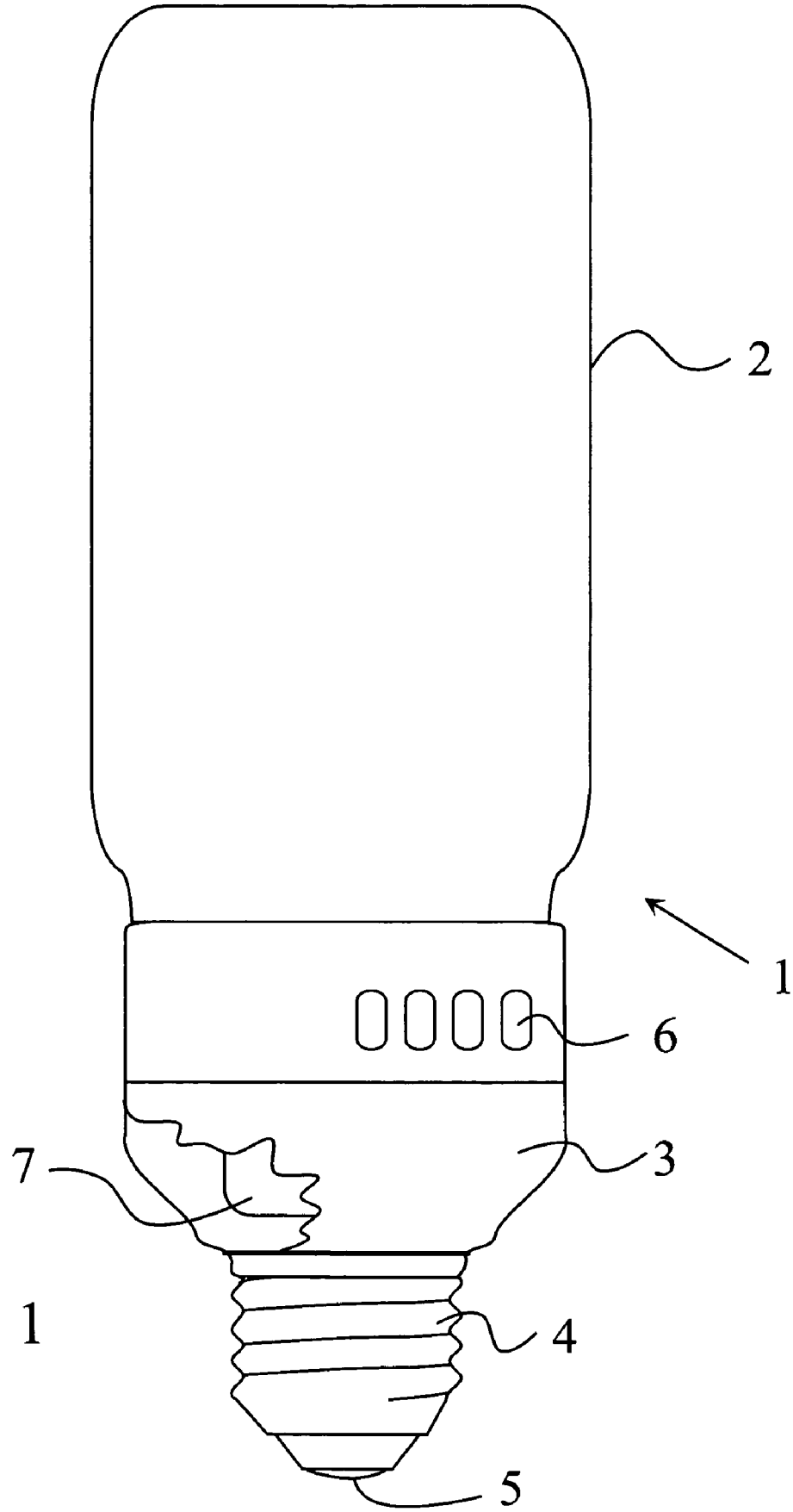
FIG. 1 is a side view of a dielectric barrier discharge lamp with an essentially tubular or cylindrical discharge vessel.

Referring now to FIG. 1, there is shown a low pressure discharge lamp 1. The lamp is a dielectric barrier discharge lamp (hereinafter also referred to as DBD lamp), with a discharge vessel 2, which in the shown embodiment has an externally visible envelope of a tubular shape, but, as will be explained with reference to FIGS. 2 to 4, has actually a more complex shape. The discharge vessel 2 is mechanically supported by a lamp base 3, which also holds the contact terminals 4,5 of the lamp 1, corresponding to a standard screw-in socket. The lamp base also houses an AC power source 7, illustrated only schematically.

The AC power source 7 is of a known type, which delivers an AC voltage of 1–5 KV with 50–200 kHz AC frequency, and need not be explained in more detail. The operation principles of power sources for DBD lamps are disclosed, for example, in U.S. Pat. No. 5,604,410. As shown in the embodiment of FIG. 1, ventilation slots 6 may be also provided on the lamp base 3.

It must be noted that the proposed DBD lamp need not include the AC power source, in case it is a so-called plug-in type lamp, where the essential electronic components (which may have a longer lifetime than the discharge tube itself) are included in a socket receiving a plug-in-type lamp base. Typically, the so-called electronic ballast needed for the start-up of the lamp is often separated from the lamp.

The internal structure of the discharge vessel 2 of the DBD lamp 1 is explained with reference to FIGS. 2–4. The wall of the discharge vessel 2 encloses a discharge volume 13, which is filled with discharge gas. In the shown embodiment, the shape of the external envelope of the discharge vessel 2 is determined by an outer tubular portion 8 and an end portion 11, which closes the outer tubular portion 8 from one end (top end in FIG. 2). The outer tubular portion 8 has an internal surface 15.

Figure 2:
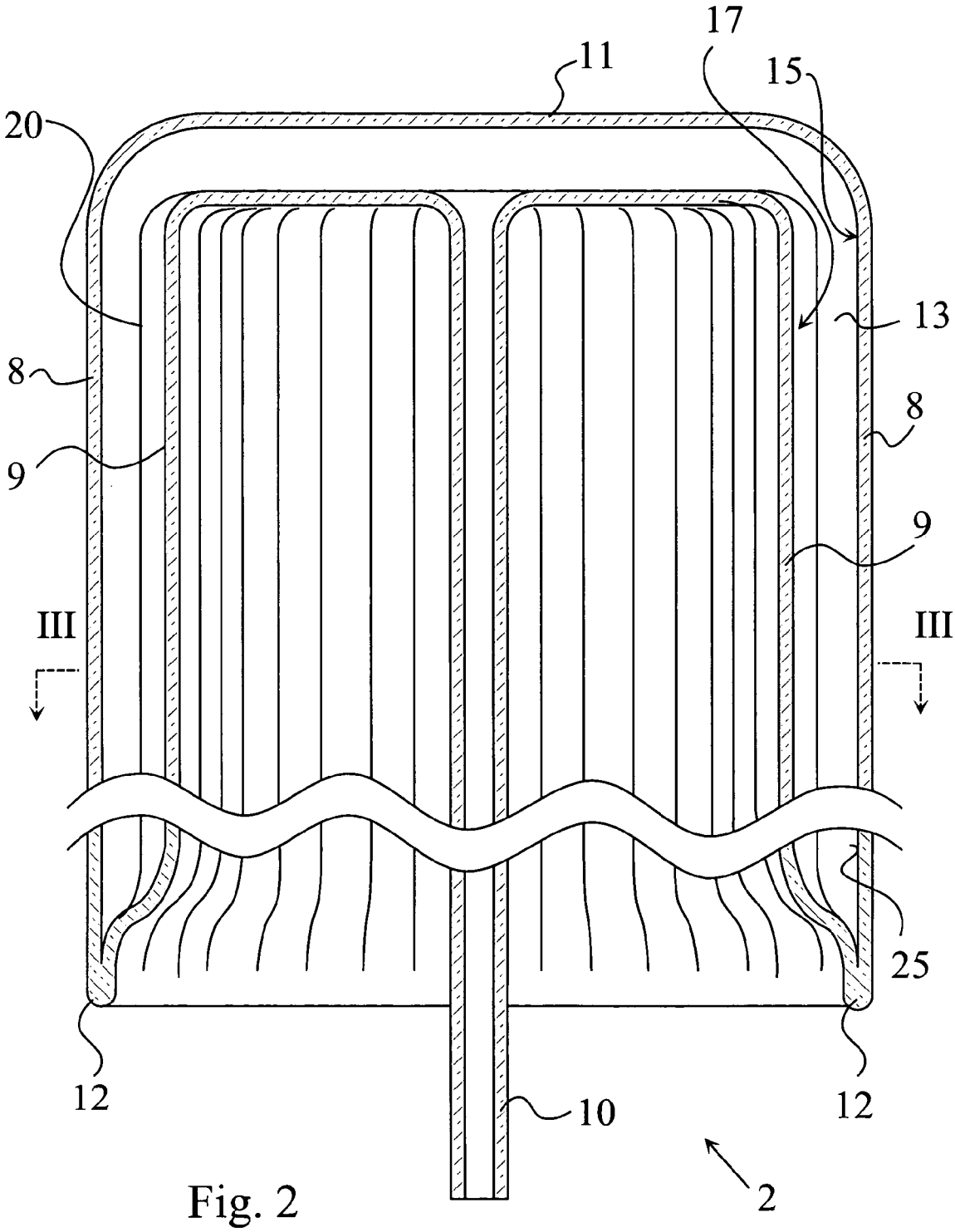
FIG. 2 is a cross section of a discharge vessel similar to that of the lamp shown in FIG. 1.

As best seen in FIG. 2, the discharge vessel resembles a double-walled structure, because it also has an inner tubular portion 9, with an outward surface 17. The outer tubular portion 8 and the inner tubular portion 9 are substantially concentric with each other, in the sense that the outer tubular portion 8 surrounds the inner tubular portion 9. The inner and outer tubular portions 9,8 are joined at their common end 12. In this manner, the discharge volume 13 is in fact enclosed between the internal surface 15 of the outer tubular portion 8 and the outward surface 17 of the inner tubular portion 9. The joint at the end 12 is sealed, and thereby the discharge volume 13 is also sealed. In this manner, a substantially annular discharge volume 13 is enclosed between the internal surface 15 of the outer tubular 8 portion and the outward surface 17 of the inner tubular portion 9.

The discharge vessel 2 is made of glass. The wall thickness $d_d$ of the inner tubular portion 9 is approx. 0.5 mm. As it will be explained below, the wall of the inner tubular portion 9 also plays a role as the dielectric in the dielectric barrier discharge. Therefore, it is desirable to use a relatively thin wall for the inner tubular portion 9. The inner tubular portion 9 of the discharge vessel 2 is corrugated, as will be shown in more detail below, and it may be manufactured with the help of a suitably shaped mould, into which a softened glass cylinder is pressed with the help of vacuum or overpressure.

Figure 3:
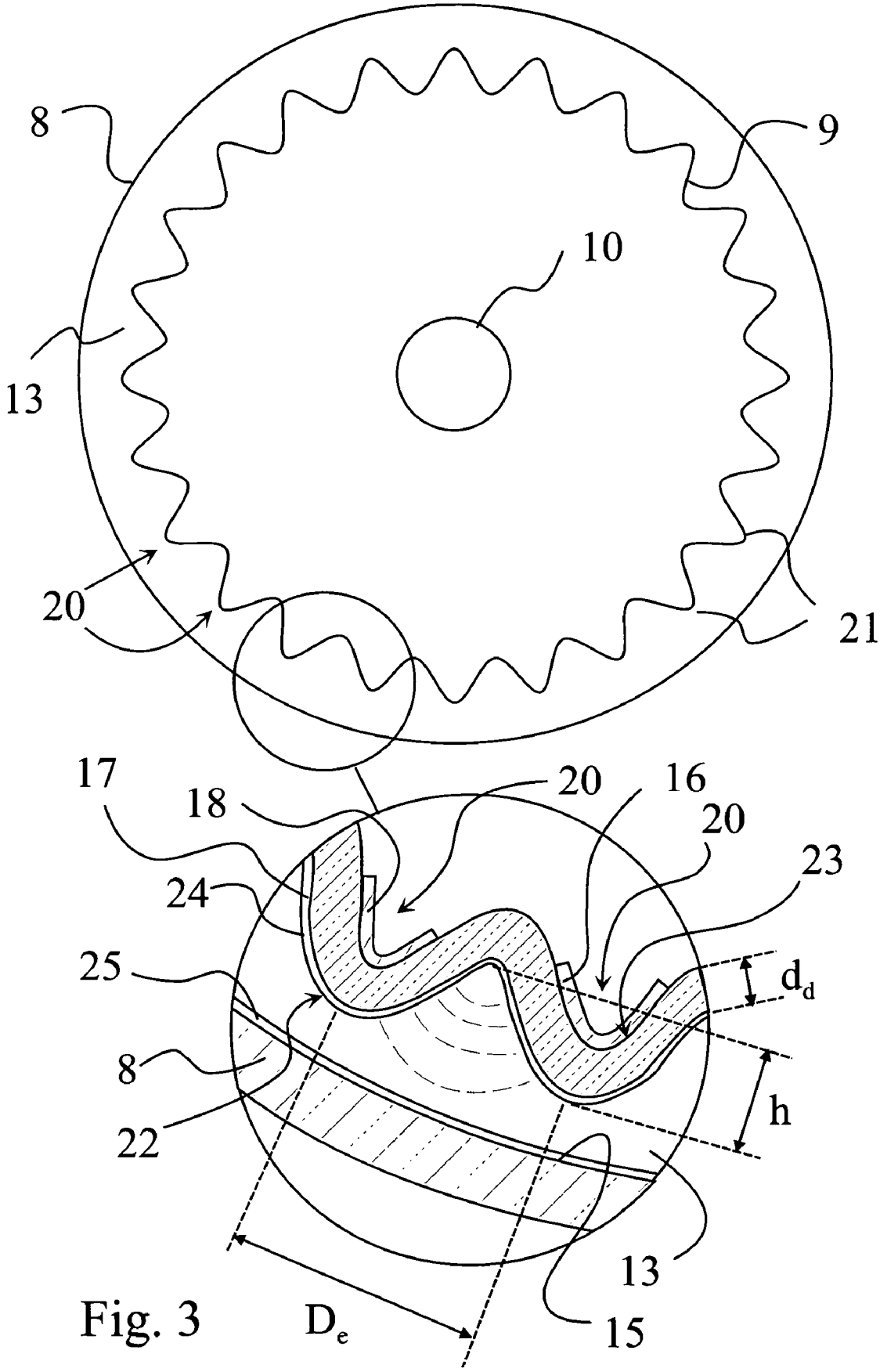
FIG. 3 is a cross section of the discharge vessel in the plane III—III in FIG. 2, with an enlarged detail showing the electrodes and the various layers.
Figure 4:
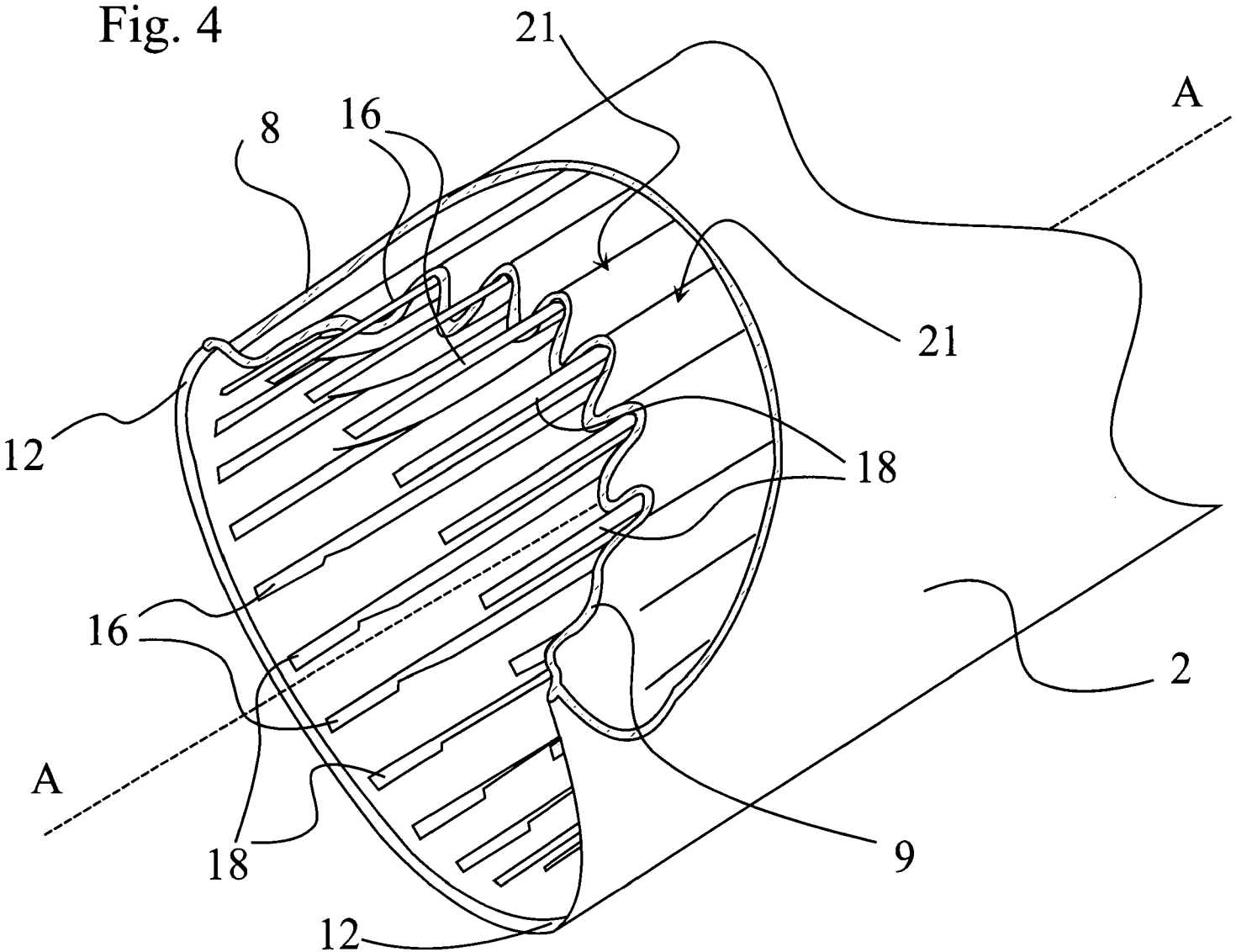
FIG. 4 is a perspective, cutout view of the discharge vessel with the electrodes.

In order to be able to manufacture the discharge vessel 2 with standard glass bulb manufacturing technology, the inner tubular portion 9 may also comprise an exhaust tube 10, such as shown in FIGS. 2 and 3. This exhaust tube 10 communicates with the discharge volume 13, and the discharge volume 13 may be evacuated and subsequently filled with a low pressure discharge gas through the exhaust tube 10 in a known manner. In FIG. 2, the exhaust tube 10 is still open, but in a finished lamp 1 it is tipped off, also in a manner known, maintaining the low pressure and sealing the discharge volume 13. As mentioned above, one end of the outer tubular portion 8 is closed with an end portion 11. The exhaust tube 10 extends along the central principal axis of the inner tubular portion 9, so that a free end of the exhaust tube 10 is opposite to the closed end of the outer tubular portion 8.

In order to provide a visible light, the internal surface 15 and also the internal surface of the end portion 11 is covered with a phosphor layer 25. This phosphor layer 25 is within the sealed discharge volume 13. The efficiency of the lamp may be improved if also the outward surface 17 is covered with a phosphor layer, or, as shown in the FIG. 3, with a reflective layer 24. The reflective layer 24 is reflective in the UV or visible wavelength ranges, reflecting on one hand the UV radiation emanating from the discharge towards the phosphor layer 25, on the other hand it also may reflect the visible light outward from the discharge vessel 2. For example, the UV reflective layer may be $TiO_2$.

The dielectric barrier discharge (also termed as di electrically impeded discharge) is generated by a first set of interconnected electrodes 16 and a second set of interconnected electrodes 18. The term "interconnected" indicates that the electrodes are on a common electric potential, i.e. they are connected with each other within a set.

The first set of the electrodes 16 and the second set of electrodes 18 are formed as elongated conductors. For example, these elongated conductors may be formed of metal stripes or metal bands, which extend substantially parallel to the principal axis of the inner tubular portion 9. Such electrodes may be applied onto the glass surface of the inner tubular portion 9 with any suitable method, such as tampon printing or by gluing thin foil strips onto the glass surface. However, the electrodes 16,18 may be formed of thin wires as well.

In the proposed discharge vessel design, the inner tubular portion 9 comprises a multitude of protrusions 20 around its circumference. The protrusions 20 extend into the substantially annular discharge volume 13. In the embodiment shown in FIGS. 2 to 4, the inner tubular portion 9 comprises a corrugated surface. The protrusions 20 are actually formed by a multitude of corrugations 21. As best seen in FIG. 4, the corrugations 21 are substantially parallel to a principal axis A of the inner tubular portion, which is also the principal axis of the tubular discharge vessel 2, substantially coinciding with the exhaust tube 10 (the latter is not shown FIG. 4).

As it is best perceived from FIG. 3, the corrugations 21 are a direct result of the fact that the inner tubular portion 9 has an undulating contour in a cross section perpendicular to the principal axis A. In the embodiment shown in FIG. 3, this undulation is substantially sinusoidal, but other waveforms are equally applicable for the purposes of the invention.

Due to the sinusoidal form, the protrusions 20, more properly the corrugations 21, have a convex surface 22 and a concave surface 23. The convex surface 22 turns towards the annular discharge volume 13, while the concave surface 23 turns towards the inside of the inner tubular portion 9. As best seen in the enlarged detail of FIG. 3, the electrodes 16,18 are located in the protrusions 20 at their concave surface 23. As a result, the electrodes 16, 18 are better surrounded by the discharge volume 13, and the electric field in the discharge volume will increase substantially.

The smallest distance between the internal surface 15 of the outer tubular portion 8 and the outward surface 17 of the inner tubular portion 9 is approx. 5 mm (not considering the region around the ends 12), but in other embodiments it may vary, preferably between 3–11 mm. The "smallest distance" is meant as the average distance between the top of the protrusions 20 and the internal surface 15.

Every protrusion 20 supports an electrode alternating from the first set and the second set. In this manner, the electrodes 16 and 18 are distributed along the internal surface of the inner tubular portion 9 substantially uniformly and alternating with each other. In the shown embodiment, the distance $D_e$ between two neighboring electrodes of opposite sets is approx. 3–5 mm. This distance is also termed as the discharge gap, and its value also influences the general parameters of the discharge process within the discharge vessel.

On the other hand, the electrodes 16 and 18 are isolated from the discharge volume 13 by the wall of the discharge vessel 2. More precisely, it is the wall of the inner tubular portion 9 which serves as the dielectric layer. As best seen in FIG. 3, both the first and second set of the electrodes 16 and 18 are located external to the discharge vessel 2. Here the term "external" indicates that the electrodes 16 and 18 are outside of the sealed volume enclosed by the discharge vessel 2. This means that the electrodes 16 and 18 are not only separated from the discharge volume 13 with a thin dielectric layer, but it is actually the wall of the discharge vessel 2—presently the inner tubular portion 9—which separates them from the discharge volume 13, i.e. for both sets of the electrodes 16 and 18 the wall of the discharge vessel 2 acts as the dielectric layer of a di electrically impeded discharge. There is no need for further dielectric layers between the glass walls and the electrodes, or covering the electrodes, though the use of such dielectric is not excluded in certain embodiments.

As mentioned above, in a possible embodiment, the wall thickness $d_d$ of the discharge vessel 2 at the inner tubular portion 9 is approximately 0.5 mm. This thickness is a trade-off between the overall electric parameters of the lamp 1 and the mechanical properties of the discharge vessel 2.

As shown in FIGS. 2 and 3, a phosphor layer 25 covers the internal surface 15 of the outer tubular portion 8. The composition of such a phosphor layer 25 is known per se. This phosphor layer 25 converts the UV radiation of the excimer de-excitation into visible light. It is also possible to cover the outward surface 17 of the inner tubular portion 9 with a similar phosphor layer. Alternatively, as in the embodiments shown in the figures, the outward surface 17 of the inner tubular portion 9 may be covered with a reflective layer 24 reflecting in either in the UV or visible wavelength ranges, or in both ranges. Such a reflective layer 24 also improves the luminous efficiency of the lamp 1. The phosphor layer 25 and the reflective layer 24 are applied to the tubular portions of the discharge vessel before they are sealed together at the end 12.

Figure 5:
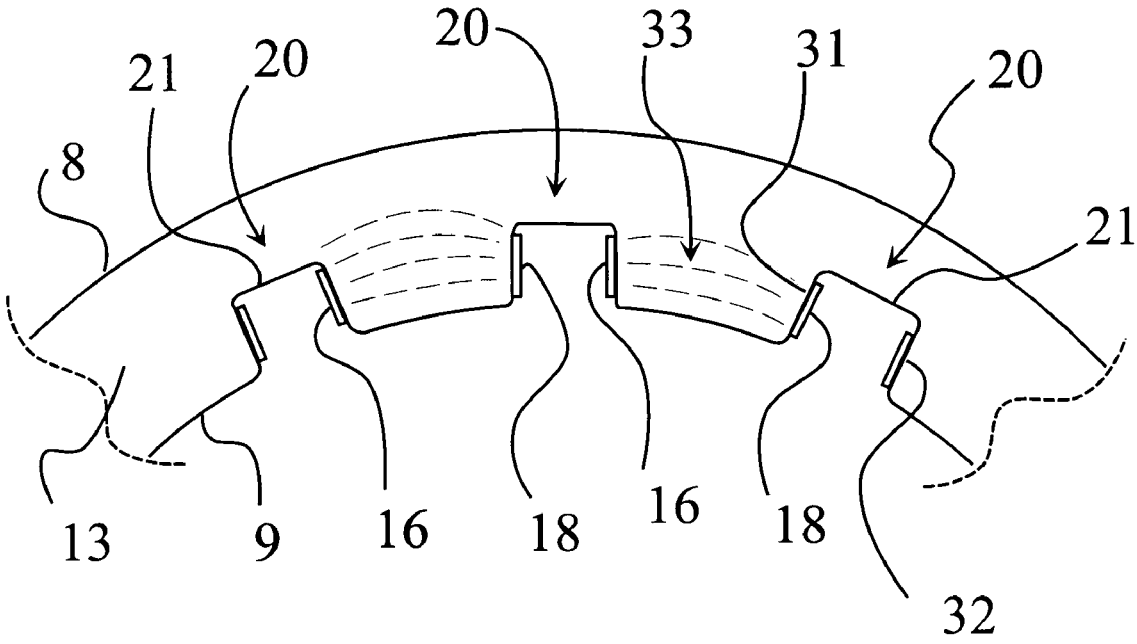
FIG. 5 illustrates a further embodiment of the discharge vessel, with differently formed protrusions, in a partial cross-section similar to that of FIG. 3.
Figure 6:
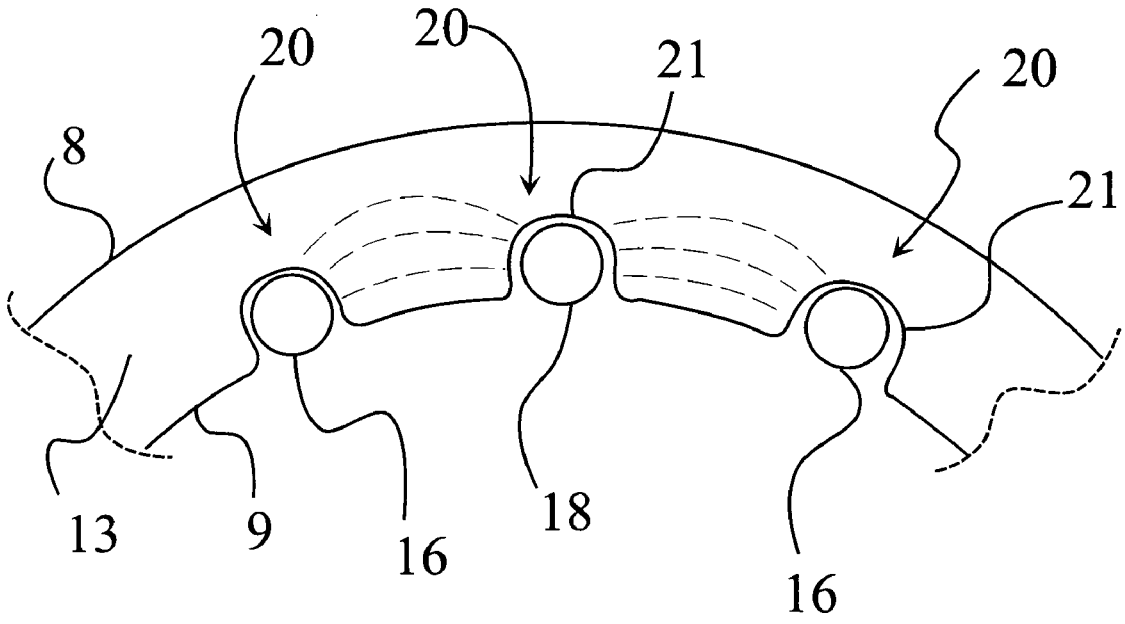
FIG. 6 illustrates yet another embodiment of the discharge vessel with differently formed protrusions, in a view similar to that of FIG. 5.

FIGS. 5 and 6 illustrate further embodiments of the discharge vessel 2. In the embodiment shown in FIG. 5, the protrusions 20 are also formed as corrugations 21 substantially parallel to the principal axis of the discharge vessel 2, but with a different form. Here, the sides 31,32 of the corrugations 21 extend substantially radially relative to the center of the discharge vessel, and the electrodes 16,18 are not at the top of the corrugations 21, but on the sides 31,32. In this manner, the electric field 33 between the electrodes 16, 18 is more homogenous. At the same time, the electrode pairs within one protrusion 20 act as capacitors, which makes it easier to bring the electrodes to the desired potential.

In the embodiment shown in FIG. 6, the protrusions 20 are substantially semi-circular, and the hollow tubular electrodes 16, 18 substantially completely fill out the protrusions 20. Such an electrode arrangement reduces the dissipation losses at the edges of strip-like electrodes, and at the same time directs a large portion of the electric field into the discharge volume 13.

In all embodiments shown, it is preferred that the wall thickness of the inner tubular portion should be substantially constant, mostly from a manufacturing point of view.

A really effective increase in the electric field strength within the discharge volume 13 may be achieved if the height h of the protrusions is larger than the wall thickness d, as shown in FIG. 3. Advantageously, the height of the protrusions 20 should be at least twice, preferably 5–10 times the value of the wall thickness d. For example, with a wall thickness $d_d$ of 0.5 mm the height h of the protrusions 20 may be between 2–4 mm. Numerical simulations of the electric field showed a doubling of the electric field strength within the discharge volume in the case of the discharge vessel-electrode configuration shown in FIG. 3, as compared with an in-plane electrode configuration (similar to that disclosed in FIG. 6*a* of U.S. Pat. No. 5,994,849), all other relevant parameters, such as electrode shape, distance, voltage, etc. being the same.

Finally, it must be noted that the parameters of the electric field and the efficiency of the dielectric barrier discharge within the discharge volume 13 also depend on a number of other factors, such as the excitation frequency, exciting signal shape, gas pressure and composition, etc. These factors are well known in the art, and do not form part of the present invention.

The invention is not limited to the shown and disclosed embodiments, but other elements, improvements and variations are also within the scope of the invention. For example, it is clear for those skilled in the art that a number of other forms of the protrusions may be suitable for the purposes of increasing the electric field and homogeneity. The general shape of the discharge vessel need not be strictly cylindrical, for example, a conical or frusto-conical design is also suitable. Even lamps more resembling a classical bulb form may be manufactured with the proposed discharge vessel design, as long as the inner tubular portion fits into the outer bulb at its narrower end. For example, it is not at all necessary that the outer tubular portion and the inner tubular portion have the same general form. The form of the discharge vessel may be any form that is feasible to manufacture, though it is preferred to keep the average "thickness" of the annular discharge volume—i.e. the distance between the inner and outer tubular portion—more or less constant. The exhaust tube of the discharge vessel may also have a different form and location, for example it may be located at the top of the outer tubular portion of the discharge vessel, and be cut off leaving only a short stub. Also, the shape and material of the electrodes may vary.

The Invention claimed is:

1. A dielectric barrier discharge lamp, comprising a discharge vessel, the discharge vessel enclosing a discharge volume filled with discharge gas, the discharge vessel further comprising a phosphor layer within the discharge volume, further the discharge vessel comprising an outer tubular portion having an internal surface, an inner tubular portion having an outward surface, the outer tubular portion surrounding the inner tubular portion, so that a substantially annular discharge volume is enclosed between the internal surface of the outer tubular portion and the outward surface of the inner tubular portion, further the inner tubular portion comprising a multitude of axially extending protrusions around its circumference, the protrusions extending into the substantially annular discharge volume, a first set of interconnected electrodes and a second set of interconnected electrodes, the first set and second set of electrodes being isolated from the discharge volume by at least one dielectric layer, at least one of the dielectric layers being constituted by the wall of the inner tubular portion.

2. The lamp of claim 1, in which the inner tubular portion comprises a corrugated surface.

3. The lamp of claim 2, in which the corrugations am substantially parallel to a principal axis of the inner tubular portion.

4. The lamp of claim 3, in which the inner tubular portion has an undulating contour in a cross section perpendicular to the principal axis.

5. The lamp of claim 4, in which a convex surface of the protrusions turns towards the annular discharge volume, while a concave surface of the protrusions turns towards the inside of the inner tubular portion, and the electrodes are located in the protrusions at their concave surface.

6. The lamp of claim 1, in which the inner tubular portion has a substantially constant wall thickness, and the height of the protrusions is larger than the wall thickness.

7. The lamp of claim 6, in which the height of the protrusions is at least twice the value of the wall thickness.

8. The lamp of claim 1, in which the first and second sets of electrodes are formed as elongated conductors extending parallel to a principal axis of the inner tubular portion.

9. The lamp of claim 8, in which the elongated conductors associated to the first and second set of electrodes are distributed uniformly and alternating with each other.

10. The lamp of claim 8, in which the elongated conductors are metal stripes or foils or metal wires.

11. The lamp of claim 1, in which the phosphor layer covers any of the outward surface of the inner tubular portion or the internal surface of the outer tubular portion.

12. The lamp of claim 1, in which the outward surface of the inner tubular portion comprises a reflective layer reflecting in any of the UV or visible wavelength ranges.

13. The lamp of claim 1, in which the discharge vessel is made of glass.

14. The lamp of claim 1, in which the wall thickness of the inner tubular portion is approx. 0.5 mm.

15. The lamp of claim 1, in which the smallest distance between the internal surface of the outer tubular portion and the outward surface of the inner tubular portion is 3–5 mm.

16. The lamp of claim 1, in which the inner tubular portion comprises an exhaust tube communicating with the discharge volume.

17. The lamp of claim 16, in which one end of the outer tubular portion is closed, and the exhaust tube extends along a central principal axis of the inner tubular portion, so that a free end of the exhaust tube is opposite to the closed end of the outer tubular portion.

18. A discharge vessel for a dielectric barrier discharge lamp, enclosing a sealed discharge volume filled with discharge gas, comprising an outer tubular portion having an internal surface, an inner tubular portion having an outward surface, the outer tubular portion surrounding the inner tubular portion, so that a substantially annular discharge volume is enclosed between the internal surface of the outer tubular portion and the outward surface of the inner tubular portion, the inner tubular portion comprising a multitude of axially extending protrusions around its circumference, the protrusions extending into the substantially annular discharge volume.

19. The discharge vessel of claim 18, in which the inner tubular portion comprises a corrugated surface.

20. The discharge vessel of claim 19, in which the corrugations are substantially parallel with a principal axis of the inner tubular portion.

21. The discharge vessel of claim 20, in which the inner tubular portion has an undulating contour in a cross section perpendicular to the principal axis.

22. The discharge vessel of claim 18, in which the inner tubular portion has a substantially constant wall thickness, and the height of the protrusions is larger than the wall thickness.

23. The discharge vessel of claim 18, in which a convex surface of the protrusions turns towards the annular discharge volume, while a concave surface of the protrusions turns towards the inside of the inner tubular portion.

24. The lamp of claim 7, in which the height of the protrusions is at least 5 to 10 times the value of the wall thickness.

* * * * *